US006332377B1

(12) United States Patent
Pietras et al.

(10) Patent No.: US 6,332,377 B1
(45) Date of Patent: Dec. 25, 2001

(54) GRIPPING ARRANGEMENT FOR GRIPPING CASING

(75) Inventors: Bernd-Georg Pietras, Wedemark; Joerg-Erich Schulze-Beckinghausen, Garbsen; Andreas Carlsson, Sehnde, all of (DE)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 09/355,545

(22) PCT Filed: Jan. 26, 1998

(86) PCT No.: PCT/GB98/00224

§ 371 Date: Jul. 29, 1999

§ 102(e) Date: Jul. 29, 1999

(87) PCT Pub. No.: WO91/02693

PCT Pub. Date: Mar. 7, 1991

(30) Foreign Application Priority Data

Jan. 30, 1997 (GB) ..... 9701939

(51) Int. Cl.[7] ..... B25B 13/50
(52) U.S. Cl. ..... 81/57.33; 81/57.18; 81/476
(58) Field of Search ..... 81/57.33, 57.18, 81/476

(56) References Cited

U.S. PATENT DOCUMENTS

| | | | |
|---|---|---|---|
| Re. 31,993 | 10/1985 | Wesch, Jr. | 73/498 |
| D. 314,896 | 2/1991 | Haynes | D8/22 |
| 1,719,533 | 7/1929 | Cady . | |
| 2,520,435 | 8/1950 | Roman . | |
| 2,962,919 | 12/1960 | Grundmann et al. | 81/185.1 X |
| 3,015,142 | 2/1962 | Rasanoff et al. | 294/86.4 |
| 3,019,680 | 2/1962 | Daugherty et al. | 81/57.18 |
| 3,021,149 | 6/1962 | Griffin | 81/185.1 X |
| 3,256,757 | 6/1966 | Kochaver . | |
| 3,272,038 | 9/1966 | Burstall | 81/186 |
| 3,531,836 | 10/1970 | Crickmer . | |
| 3,589,742 | 6/1971 | Flick | 279/71 |
| 4,315,447 | 2/1982 | Tartaglia et al. | 81/180 B |
| 4,576,067 | 3/1986 | Buck | 81/185.1 |
| 4,631,987 | 12/1986 | Buck | 81/57.14 |
| 4,649,777 | 3/1987 | Buck | 81/57.19 |
| 4,697,830 | 10/1987 | Wood et al. | 285/27 |

(List continued on next page.)

FOREIGN PATENT DOCUMENTS

| | | | |
|---|---|---|---|
| 1060644 | 10/1963 | (GB) . | |
| 1364388 | 9/1972 | (GB) | F16L/17/02 |
| 2101197 A | 5/1982 | (GB) . | |
| 2307939 A | 9/1995 | (GB) | F16B/2/14 |
| PCT/US90/04616 | 8/1990 | (WO) | B66C/1/46 |

OTHER PUBLICATIONS

Recent Advances In The Handling, Makeup, and Running of C.R.A. Tubulars, Harris et al, SPE 36754, 1993.
Spinnerhawk and Mini–Spinner, Weatherford, 1983.
Tubing Tongs For Well Servicing and Workover, Weatherford, 1995.
Precision Makeup Systems, Weatherford, 1990.

*Primary Examiner*—Joseph H. Hail, III
*Assistant Examiner*—Willie Berry, Jr.
(74) *Attorney, Agent, or Firm*—Moser, Patterson & Sheridan, L.L.P.

(57) ABSTRACT

A gripping arrangement for gripping casing is both sufficiently flexible to conform to said casing and substantially inelastic. In a preferred embodiment the gripping arrangement comprises a sheet of zircon paper bonded to a flexible metal carrier plate which has side flanges which fit into an arcuate recess in a jaw holder and bear against the ends of an arcuate pad of resilient elastomeric material. In use, radial forces are applied uniformly through the arcuate paid whilst circumferential forces are transmitted through the flexible metal carrier plate and the side flanges to the arcuate pad and thus to the jaw holder.

13 Claims, 5 Drawing Sheets

U.S. PATENT DOCUMENTS

| | | | |
|---|---|---|---|
| 4,709,599 | 12/1987 | Buck | 81/57.18 |
| 4,712,284 | 12/1987 | Coyle, Sr. et al. | 29/240 |
| 4,774,860 | 10/1988 | Hawke | 81/57.17 |
| 4,836,064 | 6/1989 | Slator | 81/57.18 |
| 5,150,642 | 9/1992 | Moody et al. | 81/57.2 |
| 5,221,099 | 6/1993 | Jansch | 279/151 |
| 5,410,924 | 5/1995 | Krasnov | 81/57.33 |
| 5,451,084 | 9/1995 | Jansch | 294/1.1 |
| 5,484,222 | 1/1996 | Schulze-Beckinghausen | 403/207 |
| 5,669,653 | 9/1997 | Penisson | 294/116 |
| 5,671,961 | 9/1997 | Buck | 294/116 |
| 5,845,549 | 12/1998 | Bouligny | 81/57.33 |
| 5,911,796 | 6/1999 | Buck | 81/57.33 |

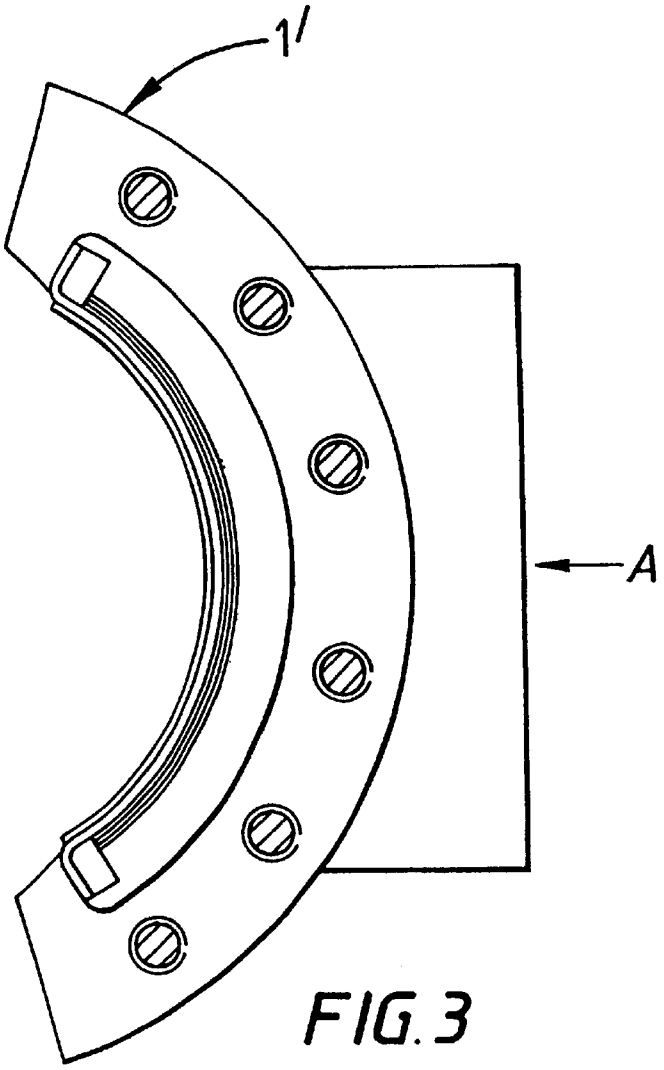
FIG. 3
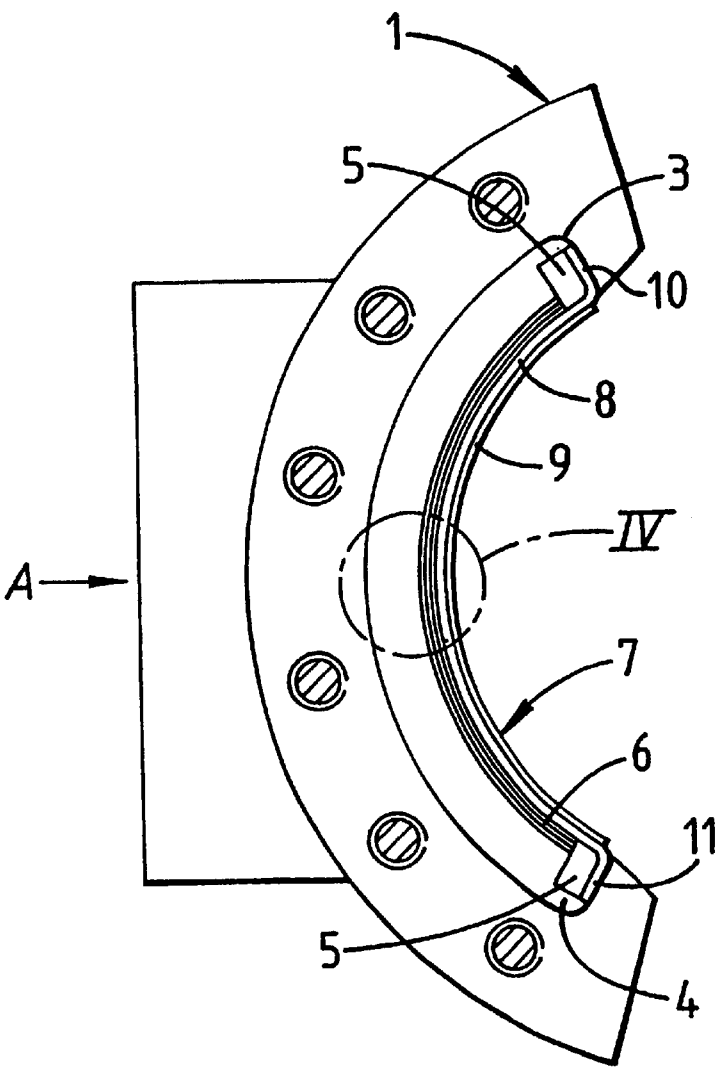

GRIPPING ARRANGEMENT FOR GRIPPING CASING

This invention relates to a gripping arrangement for gripping casing, a jaw assembly provided with such a gripping arrangement, and a tong fitted with two or more such jaw assemblies.

During the construction of oil and gas wells a wellbore is drilled into the ground. A string of tubulars, generally referred to as "casing" is then lowered down the wellbore and the annular space between the wellbore and the casing filled with cement.

Each length of casing is screwed to the next and tightened to a predetermined torque using a device known as a "tong". The tong comprises two or more jaw assemblies which can be activated to grip the casing and then rotate it about its longitudinal axis.

Historically, casing was made of thick walled steel pipe which was extremely robust. Such casing could easily be gripped by conventional jaw assemblies which were provided with teeth which penetrated the surface of the casing to obtain the desired grip.

As wells became deeper and deviated drilling became more common conventional casing was replaced by "premium" casing which is significantly lighter than conventional casing. The walls of such casing could easily be damaged by the teeth of conventional jaw assemblies and various new jaw assemblies were developed to grip premium casing whilst minimising damage thereto.

One such jaw assembly, which has been developed by the present applicants, and which is described in EP-A-0 482 158 comprises a gripping arrangement having an elastomeric substrate in which are embedded a plurality of needles the tips of which project radially inwardly to grip the casing. This jaw assembly has excellent gripping properties and causes minimal damage to the surface of premium casing. However, it is relatively expensive to manufacture and prone to the formation of "bald" spots, particularly if the casing has an irregular surface. The formation of bald spots necessitates premature replacement of the gripping arrangement.

With a view to providing a less expensive arrangement which is less prone to the formation of bald spots the present invention provides a gripping arrangement for gripping casing characterised in that it is sufficiently flexible to conform to said casing and is substantially inelastic.

It should be noted that traditional jaws are inelastic and incapable of conforming to the outside of a casing whilst the gripping arrangement of EP-A-0 482 158 is, because of its elastomeric substrate, elastic and any circumferential force applied to a needle is not distributed directly to adjacent needles.

In one embodiment the gripping arrangement comprises a sheet of grit which is preferably bonded to a carrier plate.

In another embodiment the gripping arrangement comprises a layer of flexible material having a surface with ridges and valleys, for example in the fashion of the surface of a file. The flexible material is preferably metal, for example sheet steel having a thickness of 1.5 mm. The layer of flexible material may be used in conjunction with a carrier plate or on its own.

In a further embodiment the gripping arrangement may comprise a layer of perforate material one of both surfaces of which are preferably coated with grit to facilitate adhesion. The layer will typically be formed from metal, for example sheet steel having a thickness of 1.5 mm. The layer may be used in conjunction with a carrier plate or used on its own.

In yet another embodiment the gripping arrangement may comprise a layer of expanded mesh which has been flattened. One or both surfaces of the expanded mesh may be coated with grit and the layer may be used in conjunction with a carrier plate or used on its own.

The grit may comprise, for example, diamond dust, particles of silicon, zircon, tungsten carbide and mixtures thereof.

The gripping arrangement may comprise end plates which are attached to the carrier plate.

Preferably, the carrier plate is provided with side flanges for insertion into a jaw holder.

The present invention also provides a jaw assembly fitted with a gripping arrangement in accordance with the present invention.

Preferably, the jaw assembly includes a jaw holder having an arcuate recess which accommodates an arcuate pad of resilient elastomeric material which supports said gripping arrangement.

Advantageously, at least one shim is provided which is disposed between said arcuate pad of resilient elastomeric material and said gripping arrangement. The shim will be flexible and generally from 0.5 mm to 1.0 mm thick and made from sheet steel.

The present invention also provides a tong fitted with at least two jaw assemblies in accordance with the present invention.

For a better understanding of the present invention reference will now be made, by way of example, to the accompanying drawings, in which:

FIG. 3 is a view taken on line III—III of FIG. 2 and showing a second jaw assembly;

Figure 1:
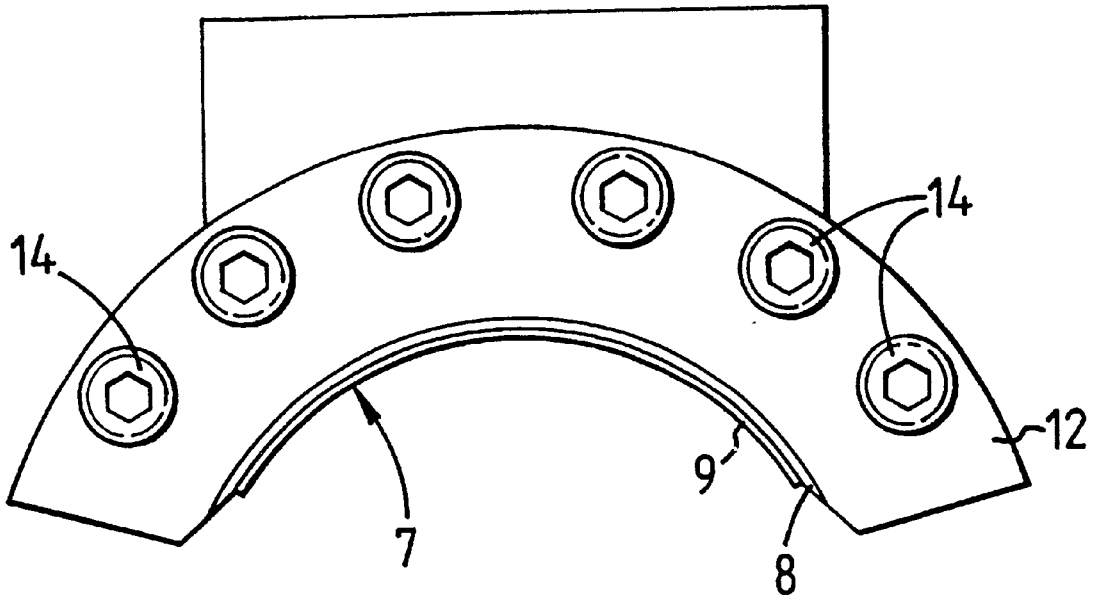
FIG. 1 is a top plan view of one embodiment of a jaw assembly in accordance with the present invention.
Figure 4:
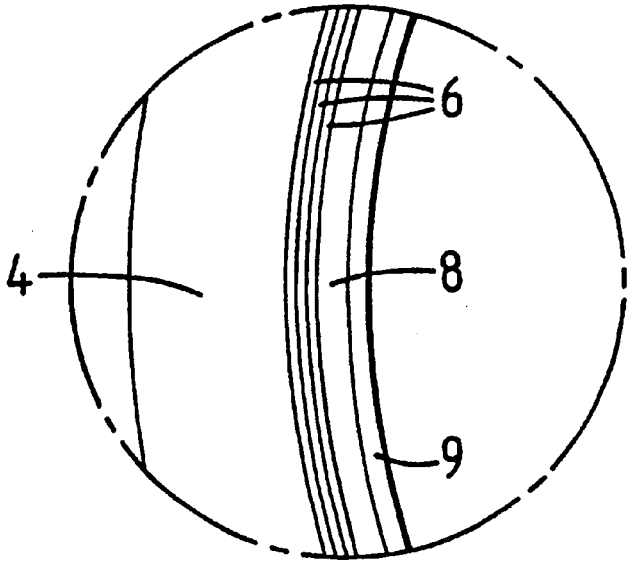
FIG. 4 shows, to an enlarged scale, the detail encircled and identified with reference numeral IV in FIG. 3.
Figure 2:
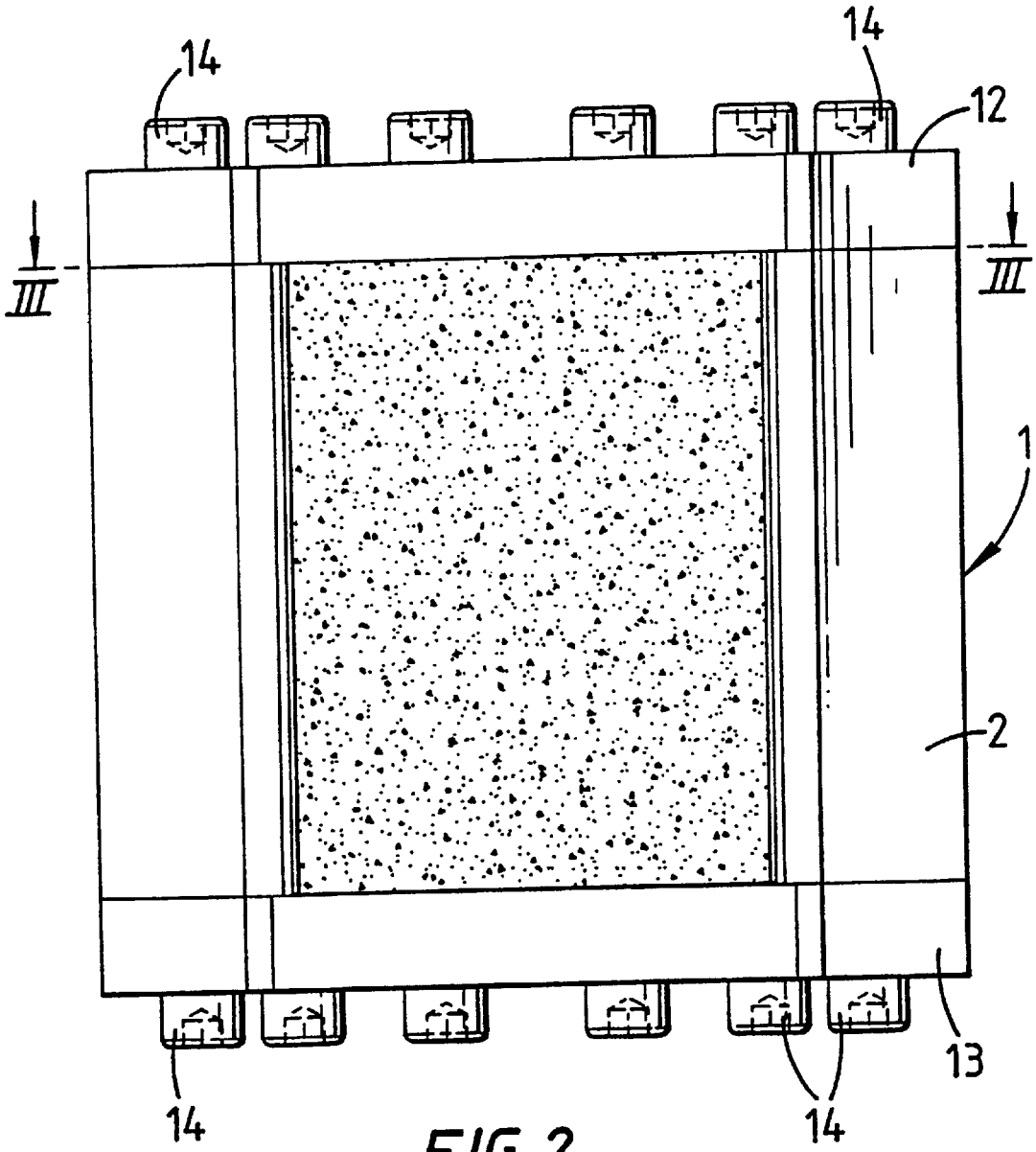
FIG. 2 is a side elevation of the jaw assembly taken on line II—II of FIG. 1.
Figure 5:
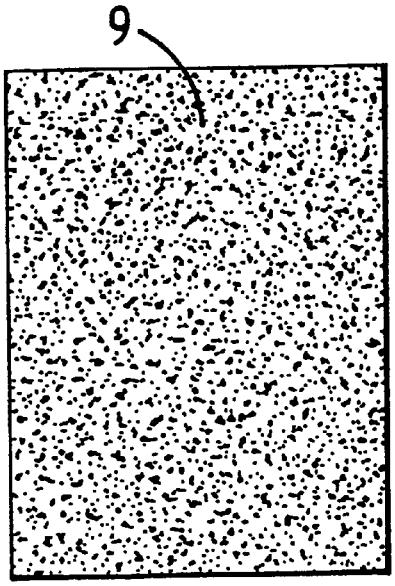
FIG. 5 is a front elevation of a first embodiment of a flexible gripping member in accordance with the present invention and which is used in the jaw assembly shown in FIGS. 1 to 4.

Referring to FIGS. 1 to 5 of the drawings there is shown a jaw assembly which is generally identified by the reference numeral 1.

The jaw assembly 1 comprises a jaw holder 2 which is provided with an arcuate recess 3 which accommodates an arcuate pad 4 of resilient elastomeric material.

A block 5 of steel is moulded into each end of the arcuate pad 4 as shown.

Three thin shims 6 of metal each having a thickness of about 0.5 mm are positioned on the inner surface of the arcuate pad 4 and support a gripping arrangement 7 which comprises a carrier plate 8 and a friction layer 9. The carrier plate 8 has side flanges 10 and 11 which clip over the blocks 5 as shown. The top and bottom of the carrier plate 8 are tack welded to end plates 12 and which are bolted to the jaw holder 2 by socket screws 14.

The friction layer 9 comprises a sheet of zircon paper which is bonded to the carrier plate 8.

The carrier plate 8 is made of sheet steel and is approximately 1.5 mm thick. As such it is quite flexible.

In uses two or more jaw assemblies are placed in a tong and are disposed around a length of casing.

The jaw assemblies 1, 1' are then advanced radially inwardly in the direction of arrows "A" (FIG. 3) until they engage and firmly grip the casing.

Because of the flexible construction of the gripping arrangement 7, the shims 6 and the arcuate pad 4, the friction layer 9 substantially conforms to the circumference of the casing and grips the casing with a substantially uniform gripping action.

Figure 9:
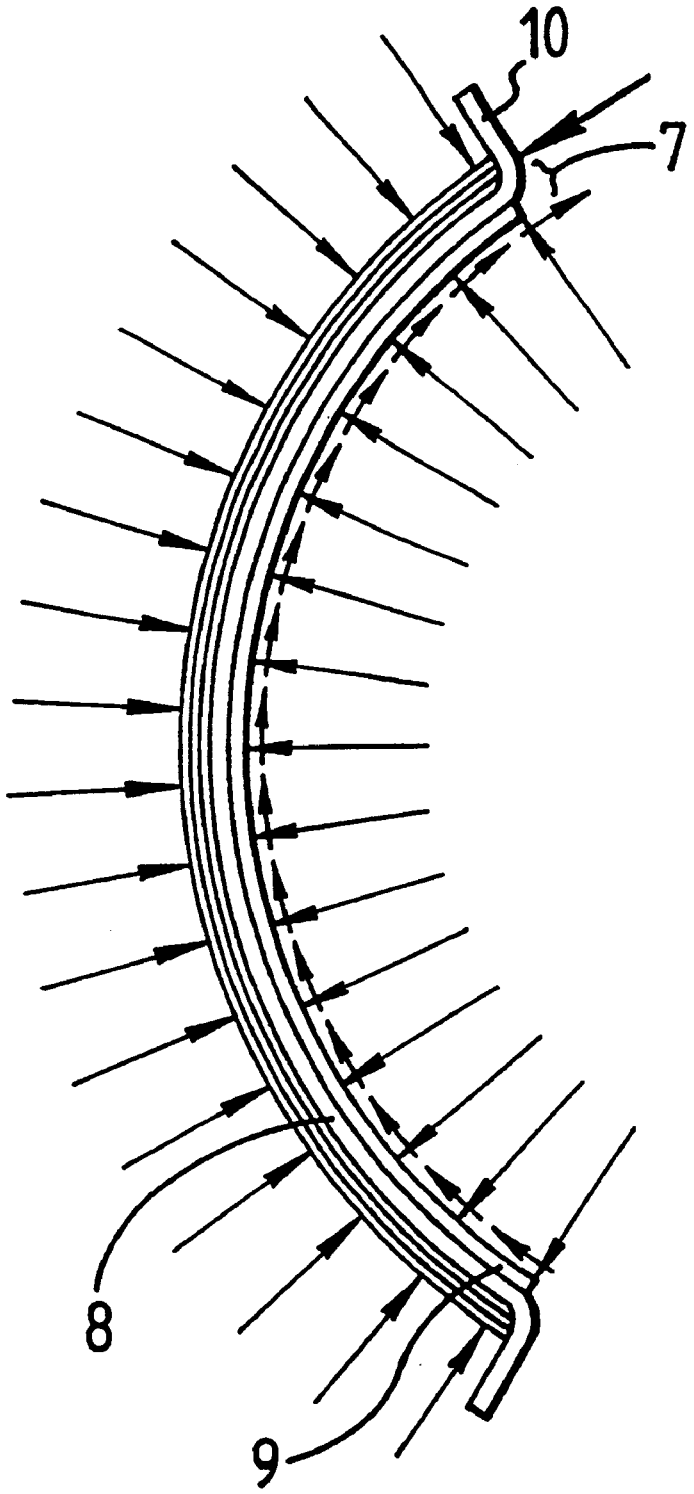
FIG. 9 shows diagrammatically how the forces are transmitted through the flexible gripping member in use.

Once the casing has been firmly gripped the jaws are rotated by the tong in the usual manner. It will be noted that circumferential forces applied to the friction layer are transmitted through the carrier plate 8 so that any local loads caused, for example by an irregularity in the surface of the casing are redistributed by the carrier plate 8 and transmitted to the jaw holder 2 via the side flange 11 and the arcuate pad 4. This is illustrated in FIG. 9.

Various modifications to the embodiment described are envisaged, for example the friction layer 9 could comprise silica paper, carborundum paper, tungsten carbide paper, or diamond paper, the term "paper" as used herein including cloth.

Figure 6:
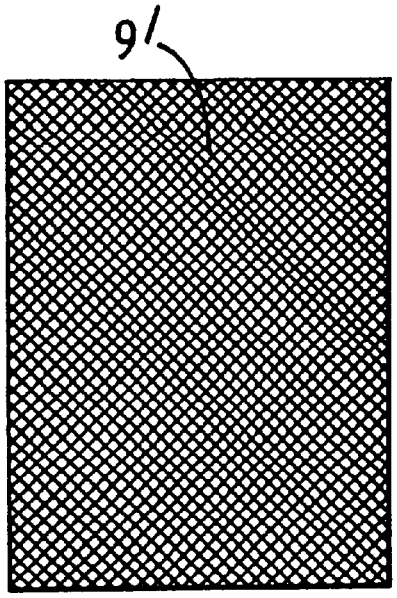
FIGS. 6, 7 and 8 show front elevations of alternative flexible gripping members.

If desired the friction layer 9 could comprise a layer of flexible material, for example metal, having a surface formed with ridges and valleys similar to the surface of a metal file. Such an arrangement is shown in FIG. 6 where the friction layer has been identified by reference numeral 9'. In this embodiment the friction layer 9' could be bonded to the carrier plate 8. However, it is conceivable that the carrier plate 8 could be dispensed with since the friction layer 9' would be capable of redistributing circumferential forces itself. If desired the blocks 5 could be disposed with, particularly if the arcuate pad 4 is made from a relatively firm resilient elastomeric material. The shims 6 might also be dispensed with although they help prevent the resilient elastomeric material of the arcuate pad 4 being extruded under pressure.

Figure 7:
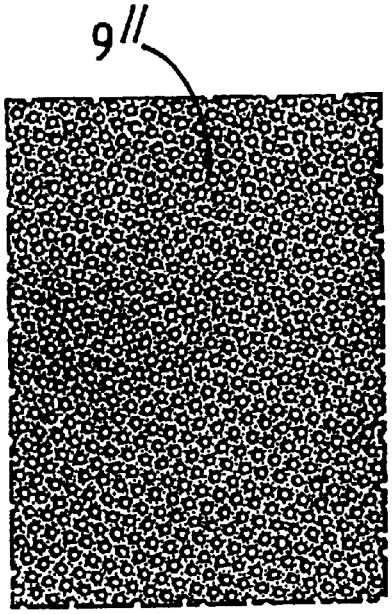

FIG. 7 shows another friction layer 9" which comprises a perforate screen the exposed surface of which is coated with grit, preferably zircon grit. This arrangement has the advantage that any paint or dirt dislodged from the surface of the casing can be accommodated in the perforations of the screen. Because of the large number of holes in the perforate screen the perforate screen is preferably used in conjunction with a carrier plate 8 to which it is preferably secured either by adhesive or by soldering or welding. It has also been found desirable to coat the surface of the perforate screen which faces the carrier plate 8 with grit to enhance the transfer of forces therebetween. If desired the carrier plate 8 could conceivably be dispensed with although this is not recommended.

Figure 8:
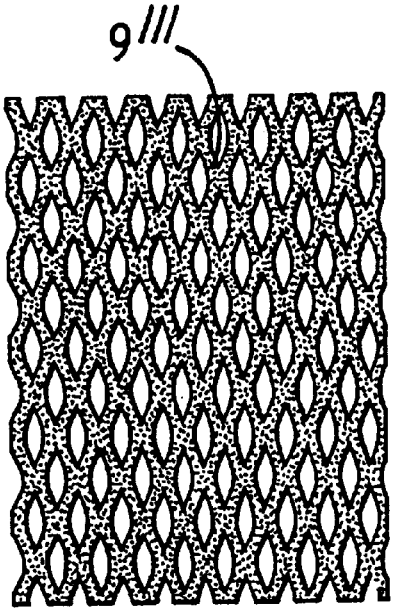

FIG. 8 shows another friction layer 9'" which is formed from expanded mesh which has been flattened between two rolls. Both surfaces of the expanded mesh have been coated with tungsten carbide grit, one to enhance gripping of the casing and the other to enhance gripping of the carrier plate 8. As with the embodiment shown in FIG. 7, the spaces between the openings in the mesh can accommodate debris which might otherwise inhibit effective gripping of the casing. If desired the outer surface of the expanded mesh could be coated with tungsten carbide grit and the inner surface brazed or soldered to the carrier plate 8.

The shims 6 could conceivably be dispensed with. However, this is not recommended since they help redistribute any localised radial loads over the surface of the arcuate pad 4.

For extremely light loads it is conceivable that the gripping arrangement 7 could simply comprise a sheet of abrasive paper without a carrier plate 8. However, this is not recommended since it would probably not be sufficiently durable.

In use, the gripping arrangement 7 can be rapidly replaced simply by unscrewing the socket screws 14, removing the end plates 12 and 13 together with the gripping arrangement 7 and installing a new arrangement. Because it is normally essential to minimise replacement time the gripping arrangement 7 will normally be supplied complete with end plates 12 and 13. However, the gripping arrangement 7 could be removably mounted on the end plates 12 and 13 if desired.

Whilst the present invention is primarily intended for gripping casing for rotation, gripping arrangements in accordance with the present invention could be used for gripping and rotating other tubulars, for example drill strings, or for use in slips, for example for supporting a casing string or drill string whilst lengths are being added thereto or subtracted therefrom.

What is claimed is:

1. A gripping arrangement for gripping casing, which gripping arrangement comprising:

an arcuate pad of resilient elastomeric material provided with a flexible substantially inelastic layer, the arrangement being such that, in use, said flexible substantially inelastic layer can transmit a circumferential force to a jaw holder and said arcuate pad of resilient material urges said flexible substantially inelastic layer, against the circumference of a length of casing to substantially conform thereto; and a flexible carrier plate disposed between said arcuate pad of resilient elastomeric material and said flexible substantially inelastic layer; wherein the flexible carrier plate is provided with side flanges for insertion into a jaw holder.

2. A gripping arrangement as claimed in claim 1 wherein said flexible substantially inelastic layer comprises a sheet of grit.

3. A gripping arrangement as claimed in claim 2 wherein said grit is selected from the group consisting of diamond dust, zircon particles, silica particles, carborundum particles and mixtures thereof.

4. A gripping arrangement as claimed in claim 1 wherein said flexible substantially inelastic layer comprises a surface with ridges and valleys.

5. A gripping arrangement as claimed in claim 1 wherein said flexible substantially inelastic layer comprises a layer of perforate material.

6. A gripping arrangement as claimed in claim 5 wherein said flexible substantially inelastic layer comprises a layer of expanded mesh which has been flattened.

7. A gripping arrangement as claimed in claim 1 wherein at least one surface of said flexible substantially inelastic layer is coated with grit.

8. A gripping arrangement as claimed in claim 7 wherein said grit is selected from the group consisting of diamond dust, zircon particles, silica particles, carborundum particles and mixtures thereof.

9. A gripping arrangement as claimed in claim 1 further comprising end plates attached to said carrier plate.

10. The gripping arrangement of claim 1, further comprising at least one shim disposed between said arcuate pad of resilient elastomeric material and said flexible substantially inelastic layer.

11. A gripping arrangement for gripping casing, which gripping arrangement comprising:

an arcuate pad of resilient elastomeric material provided with a flexible substantially inelastic layer, the arrangement being such that, in use, said flexible substantially inelastic layer can transmit a circumferential force to a jaw holder and said arcuate pad of resilient material urges said flexible substantially inelastic layer, against the circumference of a length of casing to substantially conform thereto;

a flexible carrier plate disposed between said arcuate pad of resilient elastomeric material and said flexible substantially inelastic layer: and end plates attached to the flexible carrier plate.

12. The gripping arrangement of claim 11, wherein the said carrier plate is provided with side flanges for insertion into a jaw holder.

13. The gripping arrangement of claim 12, further comprising at least one shim disposed between said arcuate pad of resilient elastomeric material and said flexible substantially inelastic layer.

* * * * *